United States Patent [19]

Ishimaru et al.

[11] Patent Number: 4,715,186

[45] Date of Patent: Dec. 29, 1987

[54] COOLANT PRESERVATION CONTAINER

[75] Inventors: Hajime Ishimaru, Ibaraki; Masao Miyamoto; Shojiro Komaki, both of Tokyo, all of Japan

[73] Assignee: Seiko Instruments & Electronics Ltd., Tokyo, Japan

[21] Appl. No.: 799,414

[22] Filed: Nov. 19, 1985

[30] Foreign Application Priority Data

Nov. 19, 1984 [JP] Japan ..... 59-244301

[51] Int. Cl.[4] ..... F17C 1/00

[52] U.S. Cl. ..... 62/45; 220/20; 220/469; 220/901

[58] Field of Search ..... 62/45, 49; 220/469, 220/901, 20

[56] References Cited

U.S. PATENT DOCUMENTS

| | | | |
|---|---|---|---|
| 2,643,022 | 6/1953 | Cornell | 62/45 |
| 3,031,856 | 5/1962 | Wiedeman et al. | 62/45 |
| 3,050,951 | 8/1962 | Gebien | 62/45 |
| 3,230,726 | 1/1966 | Bernier et al. | 62/45 |
| 3,319,433 | 5/1967 | Pauliukonis et al. | 62/45 |
| 3,374,638 | 3/1968 | Basile et al. | 62/45 |
| 3,467,269 | 9/1969 | Newton | 220/20 |
| 3,698,200 | 10/1972 | Johnson et al. | 62/45 |
| 3,838,576 | 10/1974 | Geffs | 62/45 |
| 3,938,347 | 2/1976 | Riedel et al. | 62/49 |
| 4,183,221 | 1/1980 | Yamamoto | 62/45 |

*Primary Examiner*—Ronald C. Capossela

*Attorney, Agent, or Firm*—Bruce L. Adams; Van C. Wilks

[57] ABSTRACT

A coolant preservation container having vacuum space in a peripheral portion of the interior thereof for making a container member adiabatic and a partition for dividing the container member into a plurality of chamber. Each chamber has ports from and via which a coolant is taken out from and returned to the chamber. These ports are suited to circulate a coolant contained in the chamber on external cooling trap.

18 Claims, 5 Drawing Figures

COOLANT PRESERVATION CONTAINER

BACKGROUND OF THE INVENTION

This invention relates cryogenic to a container, generally called a "dewer" for a coolant liquid, such as liquid nitrogen or liquid helium, and more particularly to a container for industrial vacuum apparatuses, which is used to supply and collect such a coolant to and from a cooling trap of a circulation system.

A conventional coolant preservation container has, as shown in FIG. 2, a container member in the inner side of an inner wall 6 of the container, wherein the inner wall 6 is surrounded by a vacuum space 5. A coolant 7 injected into the container member is taken out from a recovery port 2 so as to be practically used. In order to supply a coolant to a cooling trap, which is provided in, for example, a vacuum device, and which is adapted to be cooled by passing a coolant therethrough, according to a conventional method using the coolant preservation container of FIG. 2, it is necessary that the coolant or discharged from the cooling trap is introduced or changed into another container.

When a coolant is stored in separate containers as mentioned above, the cooling heat of the coolant which is necessarily held in the plurality of containers is apt to be rapidly lost thereby causing the coolant to be consumed at a high rate. A conventional container of this kind is inconvenient to handle, and the container is bulky.

SUMMARY OF THE INVENTION

It is therefore an object of the invention to solve above defects and provide a coolant preservation container which is used in a cooling trap without wastage of coolant. It is another object of the invention to provide a coolant preservation container which is compact and handled easily.

It is a further object of the invention to provide a coolant preservation container which controls the degree of vacuum in a chamber having the cooling trap therein.

These and other objects and advantages are achieved by a coolant preservation container of the present invention in which a container member is divided into two chambers by a partition, and a coolant introducing and a discharging port, and coolant introducing port are provided respectively.

DETAILED DESCRIPTION OF THE INVENTION

Figure 1:
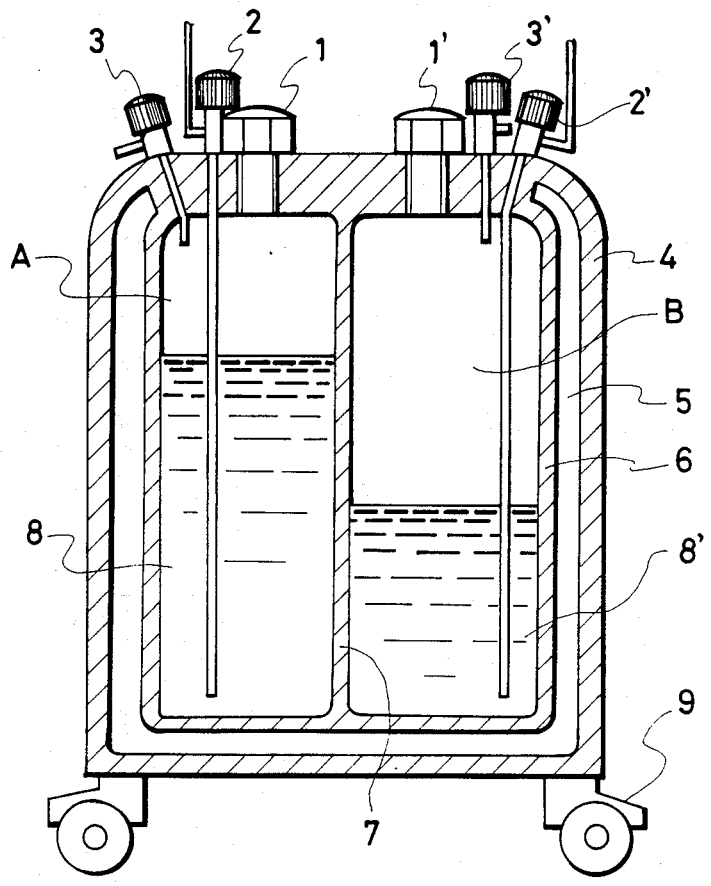
FIG. 1 is a sectional diagram of an embodiment of the present invention.
Figure 2:
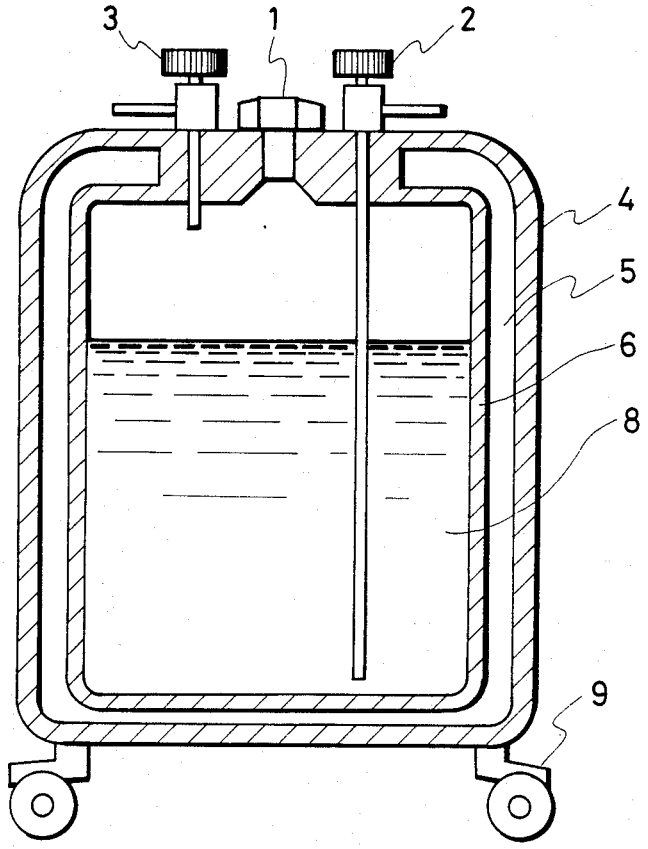
FIG. 2 PRIOR ART
FIG. 2 is a sectional diagram of a conventional container.

The explanation of the present invention referring to the drawings is as follows.

Figure 4:
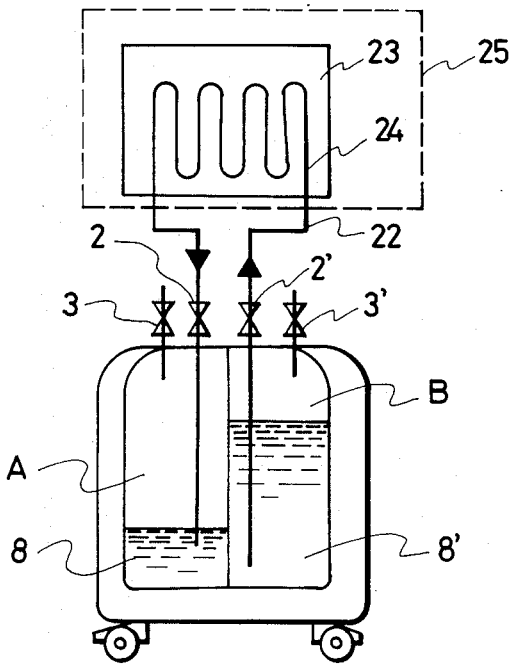

FIG. 1 is a sectional diagram of a coolant preservation container of the present invention. A space 5 surrounded by an outer wall or outer shell 4 and by an inner wall or inner shell 6 is a vacuum space, which acts as an adiabatic space for the inner or closed space surrounded by said inner wall 6. This closed space is divided into a closed chamber A and a closed chamber B by a mid-wall or partition 7, and the chambers are respectively provided with introducing ports 1, 1' for supplying coolant 8, 8', introducing or charging and discharging ports 2, 2' for circulating the coolant 8, 8', pressure regulating valves 3, 3' for independently regulating the pressure of closed chambers A and B. also, a castor 9 is mounted on said outer wall or shell 4, which enables the transportation of the coolant preservation container easily. FIG. 4 shows the connection between the coolant preservation container shown in FIG. 1 and a cooling trap. A cooling trap 23 is provided in a vacuum chamber 25, and has a pipe 24 or coolant path thereon through which the coolant flows.

The introducing or charging and discharging ports 2, 2' of the closed chambers A and B of the presently invented coolant preservation container are connected to a pair of open ends of the pipe dispersed on the cooling trap, through an external pipe 22. When the pressure regulating valve 3' of chamber B is closed to increase the pressure of chamber B, the coolant 8' in chamber B flows in the direction of the arrows, and the coolant is collected in chamber A. When the liquid level of chamber A becomes higher and the chamber becomes full, the pressure regulating valve 3 is closed to increase the pressure of chamber A, and at the same time the pressure regulating valve 3' is opened to reduce the pressure of chamber B, the coolant 8 in chamber A flows form chamber A to chamber B. In either cases, the coolant flows through pipe 24 upon the cooling trap 23, the cooling trap efficiently functions and the vacuum system 25 is evacuated.

Controlling the opening and closing of the pressure regulating valves 3, 3', controlling the introducing and discharging ports 2, 2' in accordance with the pressures in the chambers A, B, and providing coolant driving pumps in the portions of the pipe 22 which are disposed between the chambers A, B and the cooling trap 24 to make up a closed path can be done practically for the purpose of improving the coolant circulating efficiency and carrying out the bi-directional circulation correctly.

The present invention also has the additional effect of controlling the circulation of a coolant in accordance with the degree of vacuum in a vacuum system, and thereby controlling the degree of vacuum. This effect is important with respect to the point that it enables the provision of a new vacuum-degree regulating method.

Figure 3:
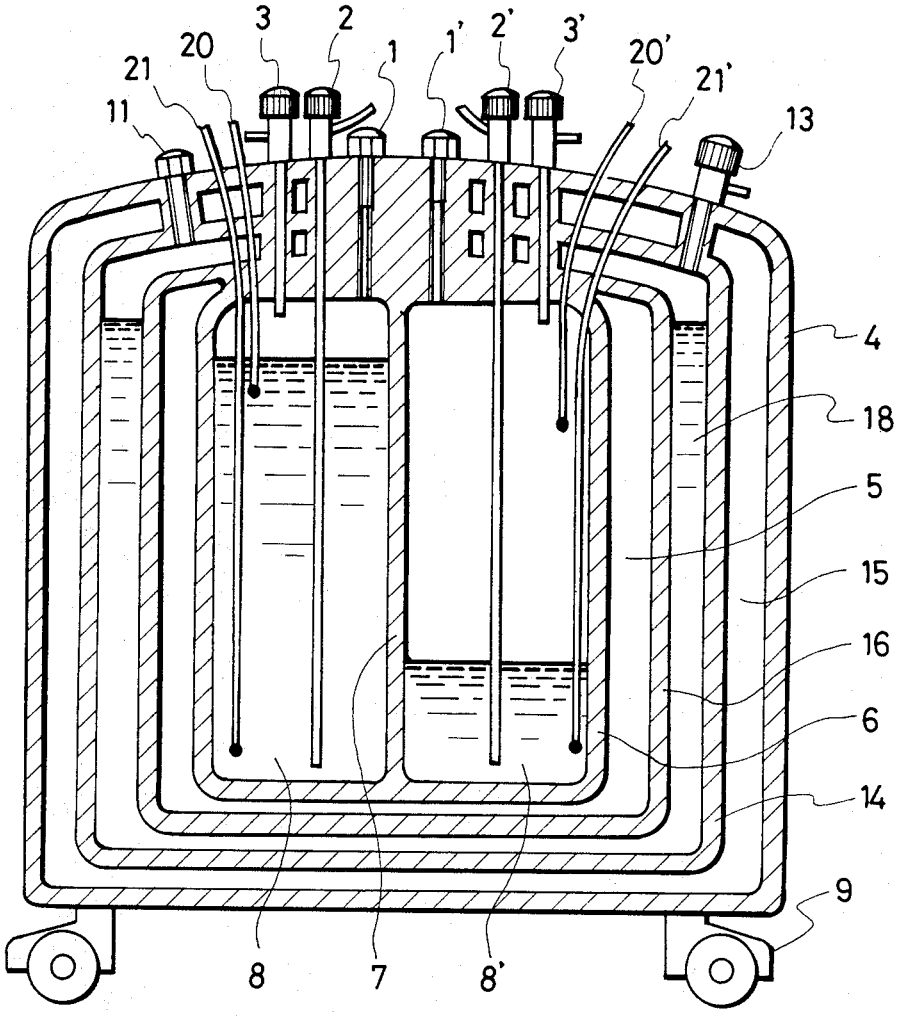
FIGS. 3 to 5 show some other embodiments.

FIG. 3 shows a sectional diagram of another embodiment of the present invention.

An outer partition 14 and an inner partition 16 are provided within the space surrounded by the outer wall 4 and the inner wall 6, and, space 5 surrounded by the inner partition 16 and the inner wall 6, and a space 15 surrounded by the outer partition 14 and the outer wall 4 are vacuum spaces for adiabatic efficiency. Into the second coolant chamber surrounded by the outer partition 14 and the inner partition 16, the second coolant 18 for high cooling efficiency is introduced. For this introduction, a pressure regulating valve 13 to regulate the pressure of the space, and a separate introducing port 11 of the second coolant 18 are provided. The space surrounded by the inner wall 6 is divided into two chambers by a mid-wall or partition 7. As in the embodiment shown in FIG. 1, respective chambers are provided with introducing ports 1, 1' for introducing coolant 8, 8', introducing and discharging ports 2, 2' to circulate said coolant 8, 8', and pressure regulating valves 3, 3' to independently regulate the pressure of both chambers, and furthermore, in this embodiment, the upper and the lower liquid level sensors 20, 20', 21, 21' to detect the liquid level of coolant are provided.

Figure 5:
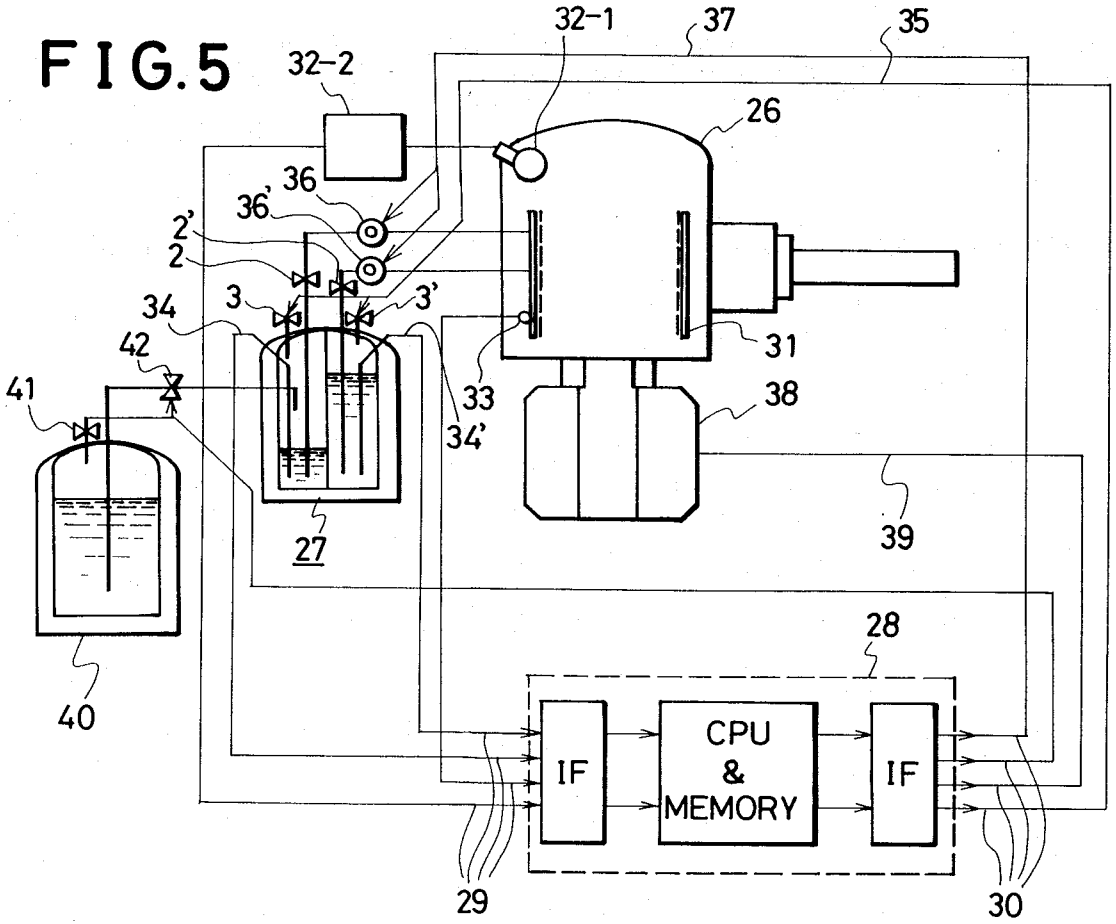

FIG. 5 shows an example of the construction of a vacuum system as a whole in which the coolant preservation container according to the present invention is used. The system shown in FIG. 5 is characterized in that the degree of vacuum in the system is controlled so as to achieve the object thereof with the bi-directional circulation of a coolant, such as liquid nitrogen also is controlled collectively at the same time.

A vacuum chamber 26 is provided with a coolant circulation type cooling trap therein. The coolant introducing and discharging ports of this coolant circulation type cooling trap 31, and the coolant introducing and discharging ports 2, 2' of presently invented coolant preservation container 27, are connected through pumps 36, 36' to make up a closed path for circulation. Into the computer control unit 28 of the vacuum system, the following three informations are input as sensor signal 29; the information of a temperature detection tip 33 of said cooling trap 31; the liquid level information of the container detected by coolant liquid level sensors 34, 34' mounted on the coolant preservation container 27; vacuum degree information of the chamber measured by a vacuum gauge 32-1 mounted on the vacuum chamber 26 and by a gauge controller 32-2. According to the above operation, the computer control unit 28 outputs a plurality of control signals 30 and controls the vacuum degree of the vacuum chamber. To be concrete, the computer control unit 28 outputs control signals such as a control signal 37 of pumps 36, 36' for assisting coolant circulation; a pressure regulating port ordering signal 35 for controlling the opening and closing of the pressure regulating valves 3, 3' of the coolant preservation container; and drive signal 39 of a vacuum pump 38 mounted on the external portion of vacuum chamber 26. Also, controller 28 also controls a pressure regulating valve 41 of a coolant supplementary container 40 and a supplementary cock 42.

The temperature of the surface of a cooling trap 21 is controlled by the above-described control system so that this temperature is kept constant. The degree of vacuum can be controlled according to circulation rates of the coolant on the basis of the input signal from a sensor 33 for the temperature of the surface of the cooling trap, a vacuum gauge 32-1 provided in the vacuum system and a controller 32-2 for the gauge 32-1 so as to answer the purpose. The present inventors ascertained that, when a better material, such as titanium is evaporated on the surface of the cooling trap 81 in the embodiment of FIG. 5 to set the air discharge rate in the cooling trap to about 3000–30000 l/s (which is about 10000 l/s when the cooling trap is formed of a cylindrical body of 50 cm in diameter and 30 cm in height having a surface area of about $5\times10^3$ cm$^2$), the degree of vacuum in the interior of the vacuum system can be regulated in the range from $10^{-9}$ Torr to not more than $7\times10^{-12}$ Torr by adjusting the temperature of the surface of the cooling trap from 196° C. to +20° C. In this embodiment, the time constant of the regulating system, especially, the time constant of the operating terminal system is about not more than 1 minute. According to, for example, the results of the experiments conducted by the present inventors, the degree of vacuum of $10^{31}$ 9 Torr is increased to $3\times10^{-11}$ Torr in about 2 minutes, i.e., a high response speed is obtained. This system is a system for regulating a super-high degree of vacuum, which could not be achieved in the past. The coolant preservation container according to the present invention constitutes one of the units supporting such a collective system.

As may be clearly understood from the above description, the present invention has various effects as follows. The dewar can be made compact, and operated easily. The individual closed chambers A, B are connected to each other by a thermally conductive single partition plate in an excellent manner so that the coolant temperature in the two chambers can be readily equalized due to conduction of heat energy through the thermally conductive partition plate, and the chambers A, B are thermally insulated from the exterior thereof. Therefore, the coolant can be preserved efficiently without a loss of cooling heat. Since the regulating valves and coolant introducing and discharging ports are provided in one outer casing or outer shell, various kinds of operations can be carried out automatically. If the sensors in this coolant preservation container and other sensors in the vacuum system are combined unitarily, the degree of vacuum can be automatically controlled.

What is claimed is:

1. A coolant preservation container comprising:
- an outerwall defining an enclosed space therein;
- an innerwall provided within said enclosed space and defining a container member therein;
- means defining at least one vacuum space formed between said outerwall and said innerwall for making said container member adiabatic;
- a partition comprised of a single, thermally conductive plate dividing said container member into a plurality of individual closed chambers; and
- at least one port provided on each individual closed chamber for introducing a cryogenic liquid into each individual closed chamber and/or for discharging the cryogenic liquid from each individual closed chamber.

2. A coolant preservation container according to claim 1 further comprising:
- an outer partition provided between said outerwall and said innerwall;
- an inner partition provided between said outer partition and said innerwall and facing the outer partition;
- a coolant chamber formed between said inner partition and said outer partition; and
- at least one separate port provided on said coolant chamber for introducing a cryogenic liquid into the coolant chamber and/or for discharging the cryogenic liquid from the coolant chamber.

3. A coolant preservation container according to claim 2; wherein said port provided on each individual closed chamber extends through said innerwall.

4. A coolant preservation container according to claim 2; wherein said port provided on each individual closed chamber extends through said inner partition and outer partition.

5. A coolant preservation container according to claim 2; wherein said means defining a vacuum space comprises first and second vacuum spaces provided between the outerwall and outer partition, and between the inner partition and innerwall, respectively.

6. A coolant preservation container according to claim 2; wherein each individual closed chamber has a sensor for detecting the liquid level of the cryogenic liquid stored therein.

7. A coolant preservation container according to claim 2; wherein each individual closed chamber has a valve for regulating the pressure therein.

8. A coolant preservation container according to claim 1; wherein said port provided on each individual closed chamber extends through said innerwall.

9. A coolant preservation container according to claim 1; wherein each individual closed chamber has a sensor for detecting the liquid level of the cryogenic liquid stored therein.

10. A coolant preservation container according to claim 1; wherein each individual closed chamber has a valve for regulating the pressure therein.

11. A coolant preservation container according to claim 1; wherein said partition is comprised of a high thermoconductivity material.

12. A container for storing coolant comprising: an outer shell; an inner shell disposed within and spaced apart from the outer shell to define an enclosed space within the outer shell; partition means comprised of a thermally conductive plate for dividing the enclosed space into a plurality of individual closed chambers and for equalizing the temperature of coolant stored in adjacent individual closed chambers by thermal conduction of heat energy through the thermally conductive plate, each individual closed chamber having means for charging coolant thereto and discharging coolant therefrom; and insulation means disposed between the outer and inner shells for thermally insulating the individual closed chambers from the outside.

13. A container according to claim 12; wherein the charging and discharging means comprises pipes inserted into the individual closed chambers.

14. A container according to claim 13; wherein the charging and discharging means further comprises valve means for regulating the pressure within each individual closed chamber and operative to release the pressure when coolant is charged into the chamber and to hold the pressure when coolant is discharged from the chamber.

15. A container according to claim 12; wherein each individual closed chamber includes sensor means for detecting the liquid level of coolant stored therein.

16. A container according to claim 12; wherein the insulation means comprises means defining a vacuum space between the outer shell and the inner shell.

17. A container according to claim 16; wherein the insulation means further comprises an intermediate insulation shell disposed in the vacuum space and surrounding the inner shell.

18. A container according to claim 17; wherein the intermediate insulation shell comprises a pair of intermediate walls spaced apart from each other to define an enclosed intermediate chamber for storing coolant.

* * * * *